United States Patent [19]

Koehler et al.

[11] Patent Number: 4,934,305

[45] Date of Patent: Jun. 19, 1990

[54] RETRACTABLE COATER ASSEMBLY INCLUDING A COATING BLANKET CYLINDER

[75] Inventors: Jamie E. Koehler, Montreal, Canada; James E. Taylor, Dallas, Tex.

[73] Assignee: Dahlgren International, Inc., Dallas, Tex.

[21] Appl. No.: 365,680

[22] Filed: Jun. 13, 1989

[51] Int. Cl.[5] ..... B05C 1/02

[52] U.S. Cl. ..... 118/46; 101/329

[58] Field of Search ..... 118/46, 258, 262, 259; 101/329, 137, 147

[56] References Cited

U.S. PATENT DOCUMENTS

| | | | |
|---|---|---|---|
| 2,320,523 | 6/1943 | Jirousek | 101/147 |
| 3,397,675 | 8/1968 | De Ligt | 118/258 |
| 3,768,438 | 10/1973 | Kumpf | 118/262 |
| 3,800,743 | 4/1974 | Egnaczak | 118/259 |
| 3,916,824 | 11/1975 | Knodel et al. | 118/224 |
| 4,222,325 | 9/1980 | Edwards | 101/137 |
| 4,270,483 | 6/1981 | Butler et al. | 118/262 |
| 4,308,796 | 1/1982 | Satterwhite | 101/143 |
| 4,372,244 | 2/1983 | Rebel | 118/262 |
| 4,615,293 | 10/1986 | Jahn | 118/46 |
| 4,685,414 | 8/1987 | Dirico | 118/262 |
| 4,706,601 | 11/1987 | Jahn | 118/262 |
| 4,753,166 | 6/1988 | Fischer | 101/329 |
| 4,796,556 | 1/1989 | Bird | 118/46 |
| 4,815,413 | 3/1989 | Kota | 118/46 |
| 4,825,804 | 5/1989 | Dirico et al. | 118/262 |
| 4,841,903 | 6/1989 | Bird | 118/46 |
| 4,852,515 | 8/1989 | Terasaka et al. | 118/262 |

*Primary Examiner*—Willard Hoag

[57] ABSTRACT

An addition to a multi-color lithographic offset printing press comprising a self-contained coating unit moveable into and out of operative relationship with the last stage impression cylinder without interrupting or disrupting printing taking place in this last stage. The coating unit includes a special blanket cylinder, a transfer roller and doctor or metering means to control the amount of coating material on the transfer roller. Inclined tracks are provided to guide the coating unit into and out of operative relationship with the impression roller of the last printing stage.

17 Claims, 3 Drawing Sheets

RETRACTABLE COATER ASSEMBLY INCLUDING A COATING BLANKET CYLINDER

BACKGROUND OF THE INVENTION

This invention relates to coating printed sheets. It more particularly refers to a process and apparatus for coating sheets which have been printed on offset printing equipment.

In many applications it is desirable to apply a spot or overall coating to a printed sheet. For example, a UV curable or water-soluble polymer finish may be applied to a workpiece printed by offset lithography. The coating on the sheet is quickly dried while the surface of the ink is still tacky. This coating avoids the need for powder driers sprayed between sheets to present offsetting of oxidation-dried inks that are slow to dry. These coatings are also useful for providing a glossy finish that improves the rub-resistance of the workpiece and improves its overall appearance and feel. Finally, adhesive coatings may be applied to printed packaging; for example, heat-set adhesives may be applied to enable attachment of a feature such as clear plastic bubble of a package used to display the product. It is said that Ultraviolet cured and aqueous overprint coatings are, by some measurements, the fastest growing segments of the printing industry.

Application of coatings to a workpiece is made difficult by various requirements. For example, the coating should be uniform and its thickness should be controlled. Moreoever, the aqueous coating should be applied quickly, before its vehicle evaporates causing it to thicken. Finally, it is desirable for the coater to operate "in line" with the press that prints the workpiece to take full advantage of the fast drying capability of coatings and generally to simplify the manufacture of printed coated workpieces.

Butler U.S. Pat. No. 4,270,483 discloses an in line coating apparatus for attachment to a conventional offset lithographic printing press. The apparatus includes a set of rollers (i.e., pick-up roller 14 and application roller 16) to deliver coating material from a reservoir 18 to a standard press unit blanket roll 108. A metering rod 40 meters the amount of coating transferred to application roller 16.

An in line coater sold by Norton Burdett Co. of Nashua, N.H. has a single roller driven directly by a D.C. motor. The roller is a gravure cylinder that transfers coating to a standard press unit blanket cylinder. The coater is attached to a pivoting arm, and the unit can be pivoted away from the press unit when the coater is not in use.

Another in line coater, sold by IVT Colordry, Inc. of Fairfield, Conn., applies coating from a reservoir pan to a standard press unit blanket cylinder using a pick-up roller that delivers a coating supply to an applicator roller; the applicator roller applies the coating to the blanket cylinder of a press unit.

Kumpf U.S. Pat. No. 3,768,438 discloses a coater in which a fountain roller dips into a coating reservoir and transfers liquid coating material to a feed roller. The feed roller in turn transfers coating material to a coating roller that coats a sheet fed between the coating roller and a format roller.

Di Rico U.S. Pat. No. 4,685,414 discloses a process and apparatus for use in combination with an existing press unit wherein the coating means is retractable, to be used or not as the printer requires. In this device, the coating means utilizes the blanket roll of the last unit of the press, and this last unit cannot be used for color application means when it is used for coating. For example in a four color press, utilizing the coating apparatus of the '414 patent would then permit only three colors to be printed in in-line, single pass operation.

Bird U.S. Pat. No. 4,796,556 discloses an offset lithographic apparatus with a plate cylinder and a blanket cylinder, and an in line coater to apply liquid coatings either in a pattern or over the entire workpiece. The apparatus has a carriage which moves the coater between a first position operative association with the plate cylinder of the lithographic press unit (see full line of unit 72 in FIG. 1) and a second position in operative association with the blanket cylinder of the lithographic press unit (see broken line of unit 72 in FIG. 1). In the first position the coater applies spot coating, and in the second position the coater applies coating over the entire sheet.

Satterwhite U.S. Pat No. 4,308,796 discloses apparatus for adapting an offset lithographic press to flexographic operations, the flexographic operation being either for coating or printing. Coating is achieved by applying a photosensitive plate to the lithographic blanket roll of the offset press. A transfer roll supplies coating to the plate. Inking is achieved in a like manner but with a flexographic plate having raised image areas.

Makosch U.S. Pat. No. 4,397,237 discloses a pivoting secondary inking system ("B" in FIG. 2).

Preuss et al. U.S. Pat. No. 3,391,791 discloses a sheet coater which moves into engagement with various cylinders in a press delivery area.

Knodel et al. U.S. Pat. No. 3,916,824 discloses a coating assembly which includes a fountain roll, a metering roll and an applicator roll for coating band of ribbon material. The coater is horizontally displaceable on an auxiliary frame.

Jahn U.S. Pat. Nos. 4,615,293 and 4,706,601 disclose separate duplex coating units disposed downstream of a printing press. The units permit coating of selected portions of the workpiece using a relief plate or permit blanket coating.

Switall U.S. Pat. No. 4,617,865 discloses a coater that can be pivoted into and out of position in contact with the blanket cylinder of the press unit; the coater being retractable with the same limits as that of the Di Rico device, i.e., the coating and printing functions cannot be performed simultaneously.

Jirousek U.S. Pat. No. 2,320,523 discloses a self-adjusting dampening roll.

Edwards U.S. Pat. No. 4,222,325 discloses a retractable dampening and inking unit.

Egnaczak U.S. Pat. 3,800,743 discloses a coater for a photoelectrophoretic process.

DeLigt U.S. Pat. No. 3,397,675 discloses a coating or printing station having its applicator and transfer rolls attached to pivotally mounted supporting frames.

Some commercial presses, such as Heidelberg GTO and MO include an extra blanket cylinder e.g., for numbering, printing extra colors, perforating, center slitting, etc. This added cylinder is a fixed part of the press, and does not retract with associated equipment for numbering or imprinting.

SUMMARY OF THE INVENTION

This invention generally features apparatus that operates on line with a sheet-fed lithographic printing press unit to apply a liquid coating to a sheet workpiece. The apparatus includes a liquid coating supply means, a special coating blanket cylinder (in addition to the blanket cylinder of the press unit), and means for metering and transfering coating material operatively connected to the coating blanket cylinder and to the liquid coating supply means, for controlling the amount of coating supplied onto the coating blanket cylinder from the supply means. Structural members integrate the means for metering and transfering coating and the coating blanket cylinder into an independent, cooperatively operating, coating assembly. The apparatus also includes a means for positively driving the coating blanket cylinder in association with the press unit impression cylinder and mounts for guiding movement of the coating assembly between an operative position, in which the coating blanket cylinder is operatively engaged with the press unit impression cylinder, and an off imprint (or off-impression) position, in which the coating blanket cylinder and drive is slightly separated from the impression cylinder (i.e., separated sufficiently to prevent contact). In the operative position the coating blanket cylinder can be accurately adjusted relative to the impression cylinder. Moreover, the coating assembly can be actuated so the coating blanket cylinder is slightly separated from the impression cylinder. Such adjustment and actuation are achieved without a change in the coating blanket cylinder position relative to the coating metering and transfer means.

The system is especially adaptable to press types such as the Heidelberg Speedmaster line of presses, where there is access on the impression cylinder of the last press unit, between the press blanket cylinder and the sheet transfer cylinder of the delivery, to add a blanket cylinder for coating. The coating blanket cylinder is adapted to provide a coating surface, which preferably is the same basic diameter as the standard printing blanket cylinder. By "adapted to provide a coating surface", we mean that the coating blanket cylinder can receive a standard resilient blanket, or it can receive a relatively hard or resilient relief plate. Alternatively, the cylinder could have a surface with permanent relief. For spot-coating, the coating blanket cylinder carries a photopolymer relief plate. This cylinder is also preferably equipped for circumferential and lateral (side) register to enable accurate positioning of the plate. Pin register may also be supplied for pre-positioning of the plate relative to the positions of upstream printing plates. Pin-register may be supplied in lieu of, or, in conjunction with circumferential and side register means. The photopolymer plate may be installed in the same blanket reels or clamps as provided for the blanket, or, may be attached to the cylinder, independent of the blanket clamping provisions.

The coating blanket cylinder continuously delivers a smooth, uniform metered amount of liquid coating material to one position of a sheet workpiece carried on the press unit impression cylinder, while at the same time, printing is immediately being applied by the press unit blanket cylinder, prior to coating, to a different position of the sheet workpiece.

Preferred embodiments of the invention are characterized as follows. The mounts guide the coating assembly to move to a fully retracted position in which the assembly and particularly the coating blanket cylinder are completely disengaged from the press unit impression cylinder at a remote location from the press unit cylinders. The coating transfer means comprises a transfer (delivery) cylinder (e.g. an engraved or smooth cylinder) in operative contact with the coating blanket cylinder, as well as a metering means (an elongated blade or a metering roll) for metering the amount of coating carried on the transfer cylinder. The coating assembly is mounted on an inclined support attached to the press frames of the delivery section of the press. Coating is circulated by recirculation means. Coating is supplied between the transfer means and the metering means, flows longitudinally along the length of the transfer and metering means and cascades at the ends thereof to a drip pan positioned below the metering means. A drip pan outlet is in operative association with the recirculation means, and the coating supply means communicates with the recirculation means, to supply recirculated coating to the transfer and metering means. The coating blanket mounted on the blanket cylinder and the press unit impression cylinder have substantially the same effective operating diameter. The apparatus includes means to control pressure or width of the nip between the transfer cylinder and the coating blanket cylinder. The apparatus also includes means to control the actuation, adjustment and speed of the transfer cylinder relative to the blanket cylinder. A gear is adapted to positively, drivingly, couple the coating blanket cylinder to the impression cylinder when the assembly is in the first (operating) position. The apparatus also includes means for adjusting the coating blanket cylinder relative to the press unit impression cylinder while the two cylinders remain drivingly engaged. An adjustable stop controls the nip between the coating blanket cylinder and the impression cylinder, without changing the relationship between the coating blanket cylinder and the liquid coating metering and transfer means. The coating blanket cylinder can be lightweight (aluminum) with means enabling lateral and/or circumferential register adjustment relative to the adjacent press impression cylinder.

This invention thus provides a direct coating system for a sheet fed printing press, preferably a multi-color press, and enables in line printing and coating at the same time on a single press unit, thus maintaining the printing capability of the printing press unit. When a press unit (preferably the final press unit) is retrofitted with the retractable coating assembly of this invention, an existing impression cylinder in the press unit acts as a common impression cylinder, so that ink is first applied to a sheet being fed on the impression cylinder and a coating is applied directly to the sheet over the last ink application. After this dual sequential application of ink and coating onto a sheet on the same impression cylinder, the coating can be suitably dried by air, infra red heat, ultra violet radiation or any other means adapted to quickly dry the coating.

This apparatus is capable of delivering a metered amount of coating through a special blanket roll to a sheet carried by the last impression cylinder in a printing press substantially without interrupting or changing the printing process. It allows spot coating or overall coating as may be desired by the printer. It operates without the use of bulky complex metering systems, yet the apparatus is versatile in that the printer can bring the coater in line or not, as he desires, without changing or interfering with an existing printing operation. Adjustment of the coating blanket cylinder and entire assembly is made relative to the impression cylinder to compensate for various sheet thicknesses to be printed. The assembly is furthermore actuatable while still drivingly engageable with the impression cylinder, to on off positioning of the cylinder when operating in the first position.

The entire apparatus is further retractable to the second position by a simple retraction device, such as a linear-actuator, winch, hydraulic cylinder or the like (not shown), up an inclined plane (the same plane as for movement for adjustment and actuation), to provide access to: (1) the coating blanket cylinder for changing blankets, packing, clean up, maintenance, etc.; (2) the standard printing blanket cylinder; (3) the impression cylinder; and (4) the sheet delivery area, beneath the coating apparatus, housing the conventional Infra red or UV drying unit. In this second retractable position, the apparatus may be used as a seat by the operator, as desired, for standard printing press unit operation.

A gear cover is provided about the blanket cylinder gear and is designed to resiliently sealingly engage the gear cover of the printing unit to which the coating apparatus is installed. When the coating unit is retracted, a cover is supplied to seal the cutout in the press gear cover. Therefore the integrity of the oil bath is maintained within the press gear cover in both operating and retracted positions of the apparatus.

A specific sequence of actuation of the transfer roll relative to the coating blanket cylinder, and actuation of the coating blanket cylinder (and, therefore, of the entire assembly) relative to the impression cylinder for proper coating operation, is specifically discussed later herein. This apparatus is well adapted to be built into a new printing press or to be retrofited into existing equipment.

Other feathers and advantages of the invention will be apparent from the following description of the preferred embodiment.

SPECIFIC EMBODIMENTS OF THE INVENTION

Figure 1A:
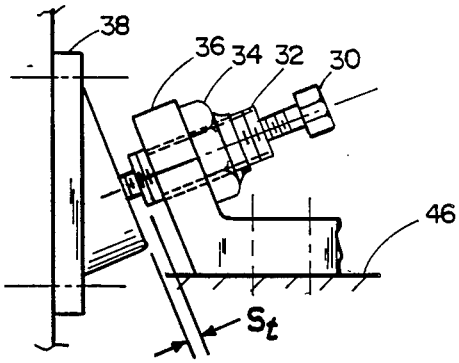
FIG. 1A is a side view of stop on the coating apparatus of FIG. 1.

This invention will be described with reference to the drawing in which like parts have been given like reference characters.

Figure 1:
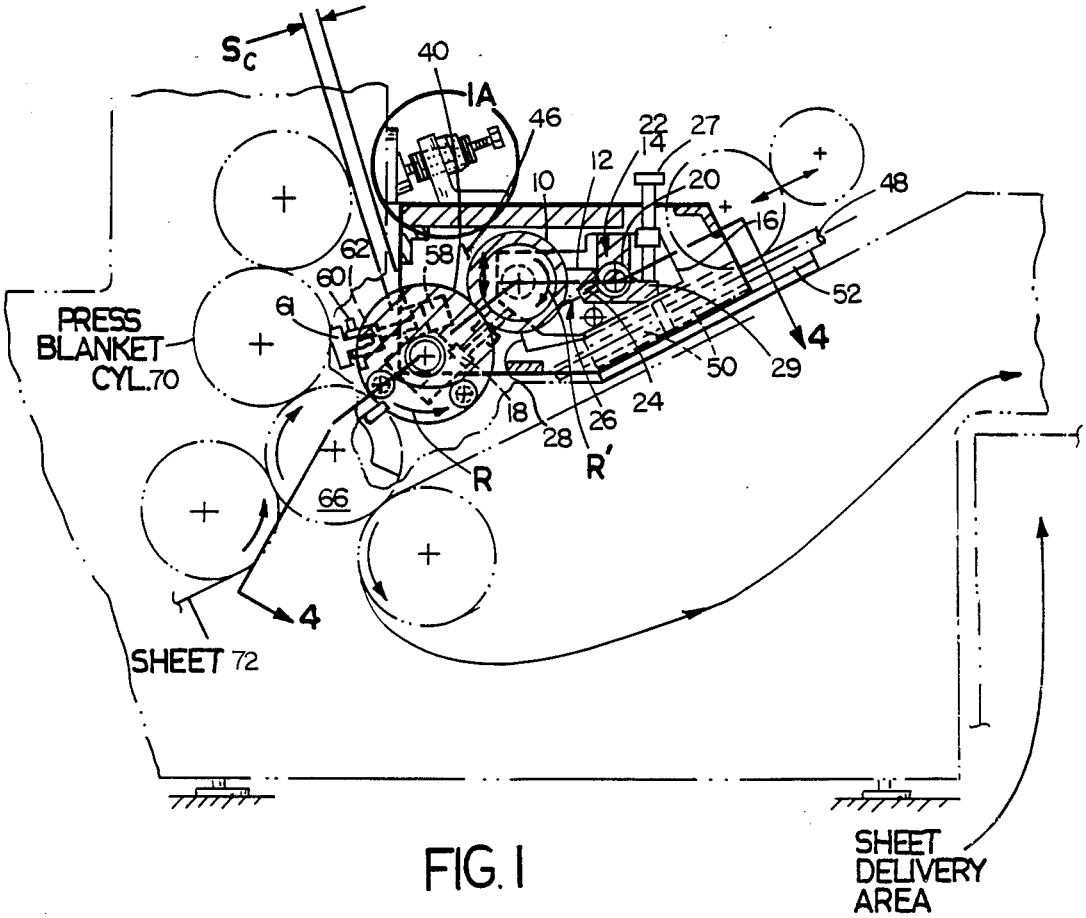
FIG. 1 is a side view of the coating apparatus including a diagrammatic view of a printing press with which it is operatively associated. In this FIG. the cylinders of the coating assembly are shown in solid in their coating operating position and in phantom in their retracted position. The coating apparatus is shown in section.
Figure 4:
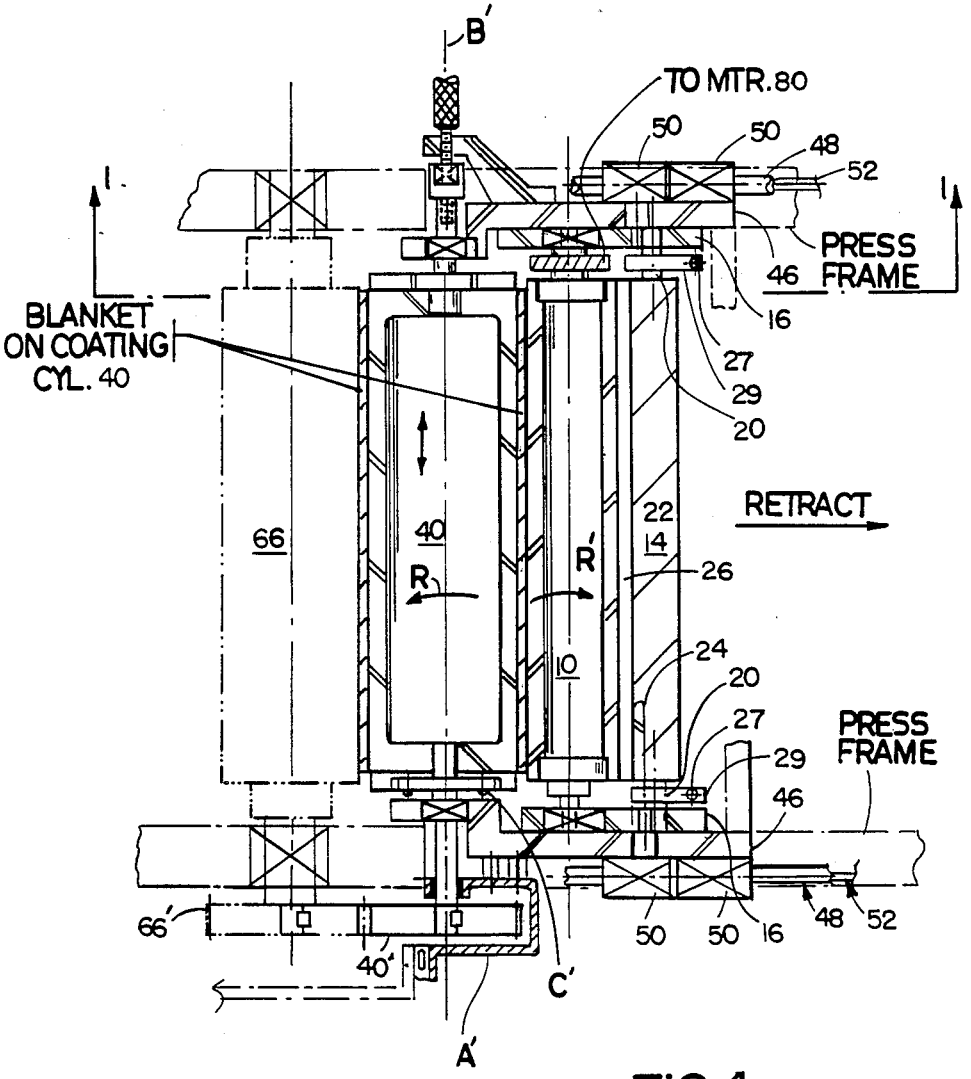
FIG. 4 is a cross-sectional view taken along lines 4—4 from FIG. 1.

Referring now to FIGS. 1 and 4, the coating apparatus assembly of this invention comprises a transfer roller 10, journalled for rotation, onto which is fed coating material 12, and a metering assembly 14 which is suitably adjustably mounted relative to the transfer roll to deliver a predetermined quantity of liquid coating, substantially evenly along the surface of the transfer roller 10. This metering assembly 14 includes a rotatably mounted journal 20 which is generally parallel to the axis of the metering roller 10. Mounted substantially centrally about the journal 20 is a housing 22 from which a blade clamp 24 extends. A doctor blade 26 is positioned in the blade clamp 24 and is angularly positioned against the metering roller 10. The doctor blade 26 is suitably made of blue spring steel, suitably about ten thousandths of an inch thick, and suitably extends out of the clamp 24 about one-half inch. The angular position of the blade 26 may be about 40° to a tangent to the transfer roller surface. It has been found to be useful to force the doctor blade 26 against the transfer roller 10 with a pressure of about one-half to one pound per linear inch. The transfer roll (with the metering device) is mounted at each end thereof in a common frame 16 which is in turn rotatably supported in a coater assembly housing 46. Frame 16 is pivotally rotated, or otherwise moved, by cylinder 57, not shown, to adjustably engage transfer roll 10 to a lightweight (e.g , aluminum) coating blanket cylinder 40 for proper coating application. Movement of frame 16 does not affect pressure between roller 10 and blade 26. Likewise, movement of housing 46 does not affect the pressure setting, or the relative positions, of transfer roll 10 and coating blanket cylinder 40. Adjustable stop 18 is provided to set a light "kiss" pressure between roller 10 and cylinder 40.

A drip pan 28 having an outlet is provided, and is positioned below the transfer roller 10 and the metering assembly 14. The pressure exerted by the doctor blade 26 against the metering roller 10 can be adjusted by means of two adjustment screws 27 which extend to corresponding adjustment brackets 29 clamped on the axle 20. It is preferred that the adjustment screws are attached to the brackets off center with respect to the axis of the axle 20 so that the rotation of these adjustment screws will pivot the axle 20 whereby changing the pressure of the doctor blade 26 on the roller 10. A cover may be provided over the coating 12 and roller 10.

A coating blanket cylinder 40 is provided in operative, takeoff contact with the transfer roller 10. The blanket roller has its own journals rotatably mounted, suitably in needle bearings, and supportingly attached to the same housing 46 as supports the common frame 16 for the transfer roller and metering assembly. This housing 46 is slidably mounted on rails 48 which, in a preferred embodiment of this invention, are inclined so as to easily move the coating assembly into and out of the line as well as provide a guide for adjustment and actuation of the coating blanket cylinder (and entire unit) relative to the impression cylinder of the press.

Specifically, the housing 46 is mounted on bearing blocks 50 that are in turn slidably mounted on the two parallel rails 48. The rails 48 are mounted on rail supports 52 which are adapted to be directly connected to the press unit.

Hydraulic cylinders 58 each with an adjustable clevis 62 are mounted on opposite sides of the housing 46 to provide proper actuation and a "kiss" pressure contact between the coating blanket on the special blanket cylinder 40 and the sheet on press impression cylinder 66. Suitably a latch 60 is provided to insure positive positioning and lock up of the entire coating assembly with relation to the printing unit, i.e., the coating blanket cylinder 40 with the impression roller 66.

Double adjusting screws 30 and 32 are supported by support 36 attached to housing 46. Screw 30 bears against stop block 38, attached to the press frame. Screw 32 is locked by nut 34. Rotation of screw 30 provides for paper pressure adjustment and thickness changes in sheet stock, while setting screw 32 provides a safety such that gears mounted on the coating blanket cylinder and press impression cylinder, cannot be meshed beyond a preset point while in the coating mode of operation. Once nut 34 is tightened, the nut is fixed (as if it were welded or pinned) for a specific screw 32 setting. Clearance "$S_c$" in FIG. 1 depends on the thickness of the sheet, $S_t$ which is generally between 0.000 to 0.030 inches. As shown in FIG. 1, clevis 62 is adjusted such that a clearance exists within cylinder 58, between the piston and cylinder wall. The piston serves as an "OFF" stop for the coating assembly when the assembly is actuated. A separation will therefore exist between the blanket and sheet when in the "OFF" impression position. For a theoretical 0.000 sheet thickness, $S_c$ should be set for 0.060 inches approximately.

A gear-motor 80, which may be hydraulic or electric, is suitably provided to drive the transfer roll 10. Suitable motorized means is provided to retract the coating assembly into and out of operative relation with the impression roller 66, up and down the rails 48.

The coating assembly is shown in cooperative relationship with a conventional series of printing rollers. The coating blanket on blanket cylinder 40 is in light "kiss" contact with the sheet on impression cylinder 66, the sheet on the impression cylinder being also in contact with a printing blanket on blanket cylinder 70; impression cylinder 66 thereby serves as a dual impression cylinder, first for printing and next for coating. The sheet work piece is shown at 72.

The coater is first locked into operation on the press unit by lowering it along the rails 48 toward the press unit and engaging clevis 62 to lug 61 mounted on the press through releasable latch pin 60. In operation, gear-motor 80 mounted on housing 46 rotates the roller 10 as coating fluid is pumped under pressure from a fluid reservoir (not shown) to an inlet opening in the doctor blade assembly. From there, coating spreads over the surface of roller 10 and is distributed by the doctor blade 26. A continuous flow of coating is maintained over the surface of the roller 10 and excess coating is recovered through a drip pan 28, with an outlet for recycling. In this way, sufficient flow is maintained to provide a flooded nip of coating between roller 10 and blade 26 and to provide uniformity of coating along the rollers' length. The amount of coating carried by the metering roller 10 can be adjusted somewhat by turning screws 27 to adjust the pressure between doctor blade 26 (or a metering roller) and the transfer roller 10, as described above. Hydraulic cylinders 58 serve to pull the entire unit against the press with a force that can be adjusted by adjusting the pressure in the cylinders 58. Screw 30 adjusts "ON" pressure between the coating blanket on blanket cylinder 40 and a sheet carried on impression cylinder 66. Cylinders 58 further serve to separate the coating blanket cylinder from the impression cylinder while gears mounted on the adjacent cylinders still remain in mesh. Separation or clearance "$S_c$" in FIG. 1 is about 0.060 to 0.030 inches to provide an "OFF" condition of the coater assembly to stop application of coating. As the blanket cylinder 40 rotates in direction R, coating is applied to the just printed sheet. Transfer roller 10 rotates as shown by direction R'.

A uniform amount of liquid coating is continuously transferred to the blanket roller 40 at the nip between the blanket roller 40 and the transfer roller 10. The blanket roller 40 in turn delivers that coating to the workpiece as the workpiece travels through the nip between the blanket roller 40 and the impression roller 66. Changing the speed of roller 10 results in a change of coat weight added to the sheet.

When the coater is not in use, latch pin 60 is released, and a motorized drive moves the coating unit back along the rails 48 away from the printing rollers.

More specifically, when using an acrylic water based coating, a suitable transfer roller may be a quadrangular cell cylinder, having about 140 lines/inch, each square inch of cells carry 15 cubic billion microns of coating. A suitably engraved roller is sold by Pararco Roller Co. of Dallas, Tex. (Exact roll cell nomenclature is: 140 Roto-flo/138 for an optimum roll surface structure.) An acrylic water-based coating having about 45% solids can be applied to achieve an optimum dry coat weight of $\approx$0.4–0.6 pounds per 1000 square feet, using a roll speed of 1:1 with that of coating blanket roll 40.

Figure 2:
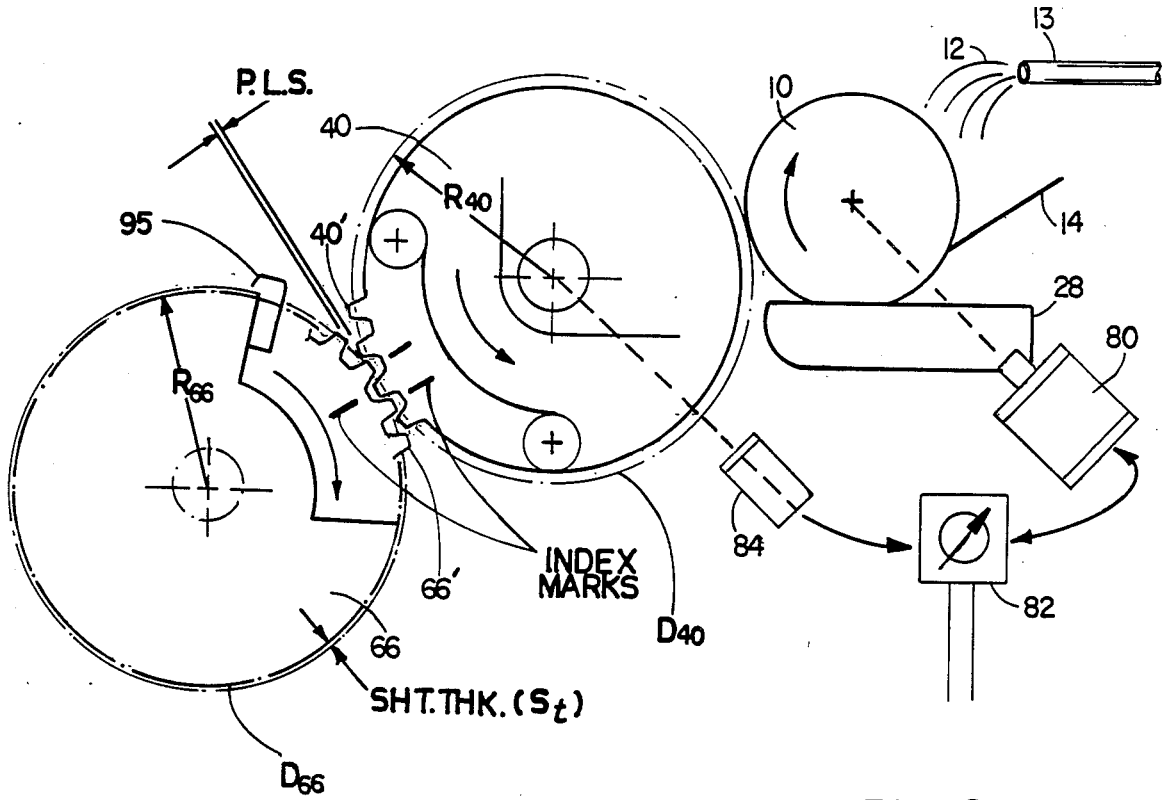
FIG. 2 is a diagrammatic side view of a set of coating application rollers showing details of controls for positively, drivingly, linking these rollers to a printing system.

Referring now to FIG. 2, there is shown a portion of a coating apparatus assembly including transfer roller 10, coating material 12 fed from a supply thereof 13 and metered onto the roller by means of a doctor blade assembly 14, including a drip pan 28. The transfer roller 10 is suitably driven by direct drive gear motor 80 whose speed is controlled by a controller 82 responding to sensor 84 which senses the speed of the coating blanket cylinder 40. Controller 82 is adjusted to provide a preset surface speed ratio, 1:1 or less, between roller 10 and cylinder 40, the slowest surface being that of roller 10. Impression cylinder 66 includes a sheet gripper 95. The coating blanket on blanket cylinder 40, and associated drive gear 40', preferably have the same operative diameter as the impression cylinder 66 and press gear 66'. Gear 40' is directly driven by press gear 66' of cylinder 66 so as to insure a positive drive relation there between. In FIG. 2, no worksheet is shown in this figure for clarity. Index marks are placed on adjacent gears to insure proper register of adjacent cylinders. The gear pitch line separation "P.L.S." is approximately equal to the sheet thickness "Sht.Thk.", $S_t$, shown on cylinder 66. $D_{40}$ is a broken line corresponding to the outer diameter of the blanket on cylinder 40, and the pitch line of gear 40' and $D_{66}$ is a broken line corresponding to the outer diameter of impression cylinder 66 and the pitch line of gear 66'. $R_{40}$ is equal to $R_{66}$ and thus $D_{40}$ and $D_{66}$ are equal.

Figure 3:
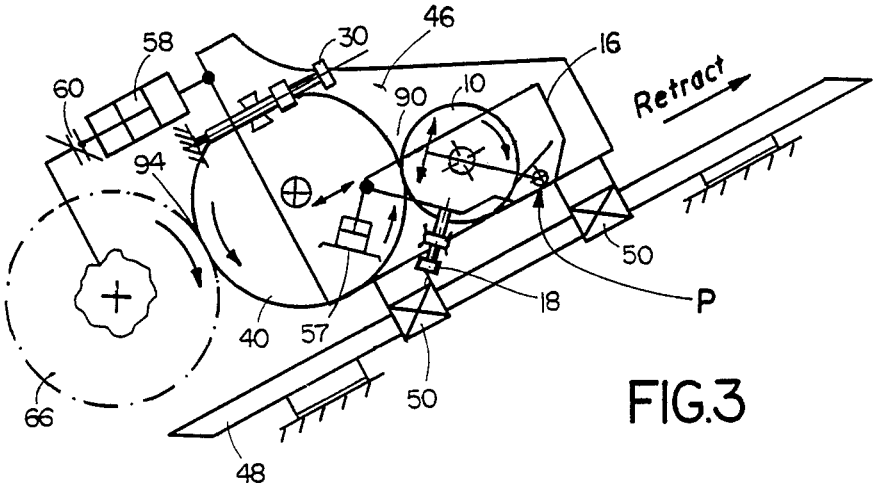
FIG. 3 is similar to FIG. 2 showing a schematic view of controls for the coating apparatus hereof for adjustment, actuation and retraction of the coating assembly relative to the press, actuation and adjustment of the transfer roll relative to the coating blanket cylinder and the metering means relative to the transfer roll.

Referring now to FIG. 3 which is similar to FIG. 2, there is shown the same three rollers, the transfer roller 10, the coating blanket cylinder 40 and the dual, common, impression roller 66. The transfer roller 10 and the coating blanket roll 40 are shown commonly mounted in assembly 46 via bearing blocks 50, on inclined rails 48. There is shown in this figure a first cylinder 57 with stop 18 which adjusts the pressure in the nip 90 between the transfer roller 10 and the coating blanket on blanket cylinder 40. A second cylinder 58 and screw 30 are provided to control the spacing in the nip 94 between the coating blanket on the blanket cylinder 40 and the dual impression cylinder 66 to accomodate a particular sheet thickness. The last color printing blanket roll 70 is not shown for clarity. Frame 16 pivots at P in FIG. 3.

FIG. 4 is a sectional view taken along lines 4—4 of FIG. 1 showing relationship or roll lengths to each other, a cover A' about the coating blanket cylinder drive gear, lateral and circumferential register provisions for the coating blanket cylinder, B' and C' respectively and other component parts shown in FIG. 1.

As best shown in FIG. 4, housing 46 is offset to the inside of the press frame in the area of the bearings for coating cylinder 40, and therefore clears the press frame in this area. The remainder of the housing may lie along the inclined surface of the frame; that is, directly above the frame. This offsetting of housing 46 prevents having to alter (cut away) a portion of the press frame adjacent the bearing.

For sequencing of rolls for proper coating operation, the following procedure is followed:

"ON" 1. Transfer roll actuates to coating blanket cylinder upon actuation of press blanket cylinder of last printing unit.

2. Coating blanket cylinder actuates to sheet on press impression cylinder upon one full revolution of press.

"OFF" 1. Transfer roll separates from coating blanket cylinder upon actuation of blanket cylinder of preceeding press unit.

2. Coating blanket cylinder separates from the sheet on the press impression cylinder upon actuation of the press blanket cylinder of the last printing unit.

OTHER EMBODIMENTS

Other embodiments are within the following claims. For example, other doctor blade arrangements may be used to doctor the coating from the transfer roller 10, such as a system utilizing a reverse angle blade or having dual blades and having a coating inlet between the two blades. A roll, or roller means, may also replace the doctor blade arrangement. Other types of engraved or smooth surfaced cylinders may be used. Other types of presses may be used in conjunction with the coater, but offset lithographic sheet feeding presses are preferred.

I claim:

1. An apparatus for applying a liquid coating to a sheet workpiece, said apparatus being adapted for operation on line with a unit of a sheet-fed lithographic printing press, said press unit comprising a press unit blanket on a press unit blanket cylinder engageable at a first printing location on a sheet workpiece on a press unit impression cylinder; said apparatus comprising:

a liquid coating supply means;

a coating blanket cylinder adapted to provide a coating surface;

a means for metering and transferring liquid coating material operatively connected to said coating surface on said coating blanket cylinder and to said liquid coating supply means, for applying a controlled amount of coating on said coating surface of said coating blanket cylinder;

structural members integrating said means for metering and transferring coating material and said coating blanket cylinder into an independent, cooperatively operating, coating assembly;

means for positively driving said coating blanket cylinder in association with said press unit impression cylinder; and mounts for guiding movement of said coating assembly between an operative position in which said coating surface on said coating blanket cylinder is operatively engaged with a second location on said sheet on said press unit impression cylinder and an off imprint position in which said coating surface on said coating blanket cylinder is slightly separated from said sheet workpiece on said press unit impression cylinder, said coating assembly including said means for metering and transferring coating material, remaining intact during movement of said coating assembly;

whereby in said operative position, said coating surface continuously delivers a smooth, uniform, metered amount of said liquid coating material to said sheet workpiece on said impression cylinder at said second location on said impression cylinder while printing is being applied by said press unit blanket to said sheet workpiece at said first location on said impression cylinder.

2. The apparatus of claim 1 wherein said means for metering and transferring coating comprises a transfer cylinder in operative contact with said coating surface on said coating blanket cylinder and means for metering the amount of coating carried on said transfer cylinder.

3. The apparatus claimed in claim 2 wherein said means for metering is a doctor means comprising an elongated blade edge positioned against said transfer cylinder.

4. The apparatus claimed in claim 1 wherein said coating assembly is mounted on an inclined support.

5. The apparatus claimed in claim 1 further including a drip pan positioned below said metering and transferring means comprising an outlet, and recirculation means in operative association with said outlet, said liquid coating supply means communicating with said recirculation means to deliver recirculated liquid coating material to said means for metering and transfering.

6. The apparatus claimed in claim 1 wherein said coating surface on said coating blanket cylinder and said impression cylinder have substantially the same effective operating diameter.

7. The apparatus claimed in claim 2 including means to control the nip betwen said transfer cylinder and said coating surface on said coating blanket cylinder.

8. The apparatus claimed in claim 1 including a gear adapted to positively couple said coating blanket cylinder to said impression cylinder when said coating assembly is in said first operating position.

9. The apparatus of claim 1 further comprising means for adjusting the coating blanket cylinder relative to the impression cylinder, while the coating blanket cylinder remains drivingly engaged with the impression cylinder.

10. The apparatus of claim 9 comprising an adjustable stop to control the nip between the coating surface on said coating blanket cylinder and the workpiece sheet on said impression cylinder, without changing the coating blanket cylinder relationship to the liquid coating metering and transfer means.

11. The apparatus of claim 1 wherein the coating blanket cylinder is a lightweight cylinder.

12. The apparatus of claim 1 wherein said coating blanket cylinder further comprises means for circumferential register with the adjacent press impression cylinder.

13. Apparatus of claim 12 wherein the coating blanket cylinder further has means enabling lateral register adjustment relative to the adjacent press impression cylinder.

14. Apparatus according to claim 13 wherein said coating blanket cylinder is adapted to receive a photopolymer plate and wherein said means for metering and transfering coating comprises a transfer cylinder, the surface of which is a transfer surface, said transfer surface and the surface of said photopolymer plate being adapted for rotation together in nip contact at substantially the same surface speeds for precision spot coating to said sheet workpiece.

15. Apparatus according to claim 1 wherein said mounts guide said coating assembly to move to a fully-retracted position in which said coating assembly and coating blanket cylinder are completely disengaged from said press unit impression cylinder at a remote location from the press unit cylinders.

16. Apparatus according to claim 1 wherein said blanket cylinder is adapted to receive a blanket for coating said sheet workpiece.

17. Apparatus according to claim 1 wherein said blanket cylinder is adapted to provide a coating plate at its surface.

* * * * *

UNITED STATES PATENT AND TRADEMARK OFFICE

CERTIFICATE OF CORRECTION

PATENT NO. : 4,934,305

DATED : June 19, 1990

INVENTOR(S) : Jamie E. Koehler et al.

It is certified that error appears in the above-identified patent and that said Letters Patent is hereby corrected as shown below:

Title page, item [75], add "Mark A. DiRico, Quincy, MA", as an inventor, immediately after --James E. Taylor, Dallas, TX--.

Signed and Sealed this

Seventeenth Day of November, 1992

*Attest:*

DOUGLAS B. COMER

*Attesting Officer*

*Acting Commissioner of Patents and Trademarks*